United States Patent [19]

Moriarty et al.

[11] 4,343,244

[45] Aug. 10, 1982

[54] PERIODICAL SHELF

[75] Inventors: Frederick J. Moriarty, Worcester; Edmund T. Paquette, Shrewsbury, both of Mass.

[73] Assignee: Wright Line Inc., Worcester, Mass.

[21] Appl. No.: 140,977

[22] Filed: Apr. 17, 1980

[51] Int. Cl.[3] ..... A47B 5/00

[52] U.S. Cl. ..... 108/1; 108/152; 211/150; 312/233; 312/313; 312/322; 312/323

[58] Field of Search ..... 312/313, 323, 322, 245, 312/301, 302, 303, 341 R, 183, 233, 314, 315, 350; 108/152, 6, 1; 211/150

[56] References Cited

U.S. PATENT DOCUMENTS

| | | | |
|---|---|---|---|
| Re. 28,994 | 10/1976 | Aylworth | 312/323 X |
| 480,693 | 8/1892 | Foster et al. | 312/301 X |
| 1,429,627 | 9/1922 | Rand, Jr. et al. | 312/303 |
| 1,916,397 | 7/1933 | Unger | 312/323 |
| 2,261,718 | 11/1941 | Connor et al. | 312/302 X |
| 2,385,593 | 9/1945 | Weston | 312/302 |
| 2,519,632 | 8/1950 | Brinker | 312/323 |
| 2,529,987 | 11/1950 | Wolters | 312/323 |
| 2,839,349 | 6/1958 | Culver | 312/323 |
| 2,901,308 | 8/1959 | Attwood | 312/303 |
| 3,044,631 | 7/1962 | Greenman et al. | 108/1 |
| 3,570,679 | 3/1971 | Edson | 108/1 X |
| 3,701,325 | 10/1972 | Fenwick | 108/1 |
| 3,716,282 | 2/1973 | Propst et al. | 312/322 |
| 4,165,852 | 8/1979 | Chervenak | 312/245 |
| 4,184,725 | 1/1980 | Spangler | 312/323 X |
| 4,265,502 | 5/1981 | Blodee et al. | 312/323 |

*Primary Examiner*—James T. McCall

*Attorney, Agent, or Firm*—Milton E. Gilbert; Gary E. Ross

[57] ABSTRACT

A component adapted for attachment to a library unit stand for use in storing magazines, pamphlets and other information-bearing media, said component comprising a frame assembly having means for attaching it to a library unit stand, and a shelf assembly mounted to the frame assembly so as to be movable from a first media-storing position where it is in a plane that is horizontal or nearly horizontal and a second media-displaying position where its rear end has been advanced and its front end has been lowered so that it is inclined at a selected angle for displaying the media stored thereon.

8 Claims, 6 Drawing Figures

PERIODICAL SHELF

BACKGROUND OF THE INVENTION

This invention relates to document storage and more particularly to provision of a shelf component for a mixed media library unit.

Modern day libraries may contain an assortment of documents. In its broadest sense a document is a medium on which an assemblage of data is recorded by writing or printing or by other processes such as those of a photographic or electronic nature. Thus, a document may be sheetlike and consist, for example, of one or more individual looseleaf pages, an accordian-folded computer printout or a prebound article such as a book or periodical. Documents also may take other forms. Thus, a document may be a reel of film or, as in computer facilities, it may consist of magnetic tape or disc.

Storage of documents in mixed media libraries is typically accomplished by means of suspension filing systems and regular shelving. Suspension filing systems have found wide use in the filing of large format items such as computer printouts, flow diagrams, program listings and the like, and a wide variety of storage files have been devised to accommodate different materials to suspension filing. A common kind of suspension filing system is the so-called center hook system, which in its simplest form comprises a single horizontal support bar to which appropriate files provided with hooks and designed to accommodate the documents to be filed may be detachably secured. One kind of storage file for center hook suspension is a modified post binder for stationery materials which incorporates in its spine a centered or eccentrically mounted hook, as disclosed in U.S. Pat. Nos. 3,865,445, 3,580,360 and 4,056,296. Reels of computer tape also may be fitted with circular storage bands adapted for center hook suspension filing, in the manner illustrated in U.S. Pat. No. 3,696,935. Those documents not easily accommodated to suspension storage with prior art files are commonly stored on regular shelving, as, for example, books, periodicals, discs and cassettes. Unfortunately in mixed media libraries employing both suspension filing systems and regular shelving, there is often a resultant loss in user convenience since related documents in different form may have to be stored remotely from one another or at least in different areas of the library. This problem has been alleviated to some extent by provision of so-called mixed media library units of the type comprising a library stand or frame to which are affixed or releasably secured components in the form of flat shelves for storing books, cassettes, and the like and horizontal support bars for accommodating reels of tape fitted with storage bands of the type described above or files with centered or eccentrically mounted hooks. These shelves and support bars are generally attached to the library stand in cantilever fashion one above the other with the spacing between such components often being adjustable. While the flat shelf components are adequate for storing items such as magazines and books, either flat or upright between book ends, they are not suitable for holding such items so that their front covers are suitably displayed to the viewer in the manner achieved with certain forms of magazine display racks.

OBJECTS OF THE INVENTION

The primary object of this invention is to provide a novel document storage component for a mixed media library unit which is arranged to store and display magazines, brochures, and other literature in a convenient manner.

A further object is to provide a storage shelf component for a mixed media library unit which is arranged to store magazines and the like so that they lie flat on the shelf with the shelf movable between a first substantially horizontal storage position and a second inclined display position.

Still another object is to provide a storage shelf component for a library unit which may be adjustably positioned on the library unit stand together with other storage components adapted for supporting like or other kinds of media and which is arranged to be movable so as to permit access to media stored by the next lower storage component.

A further object is to provide a library unit for storing like or mixed media which comprises a library unit stand and a storage component for storing and displaying magazines and the like, the storage component including a shelf which can be stored flat in a first position or disposed at an inclined angle in a second position.

SUMMARY OF THE INVENTION

These and other objects are met by providing a storage component consisting of (1) a frame assembly having means for attaching it to a library unit frame and a pair of tracks located at opposite sides of the frame assembly, and (2) a shelf having means arranged to ride along the tracks so as to permit the shelf to be moved from a first retracted position in which it is horizontal for flat storage of magazines and the like and a second extended position in which it hangs from the frame assembly at a selected angle of inclination as to display the supported magazines. The front edge of the shelf has means for retaining the magazines on the shelf when the latter is in its extended position. Means are provided at opposite sides of the storage component for supporting the shelf at said selected angle. In the preferred embodiment of the invention hereinafter described the frame assembly is provided with hooks for hanging the component in cantilever fashion from the library unit frame. Other features and many of the attendant advantages of the invention are set forth or rendered obvious by the following detailed description of the accompanying drawings.

THE DRAWINGS

The drawings illustrate a storage component constituting an embodiment of the invention. In the several views the same parts are identified by the same numerals.

Figure 1:
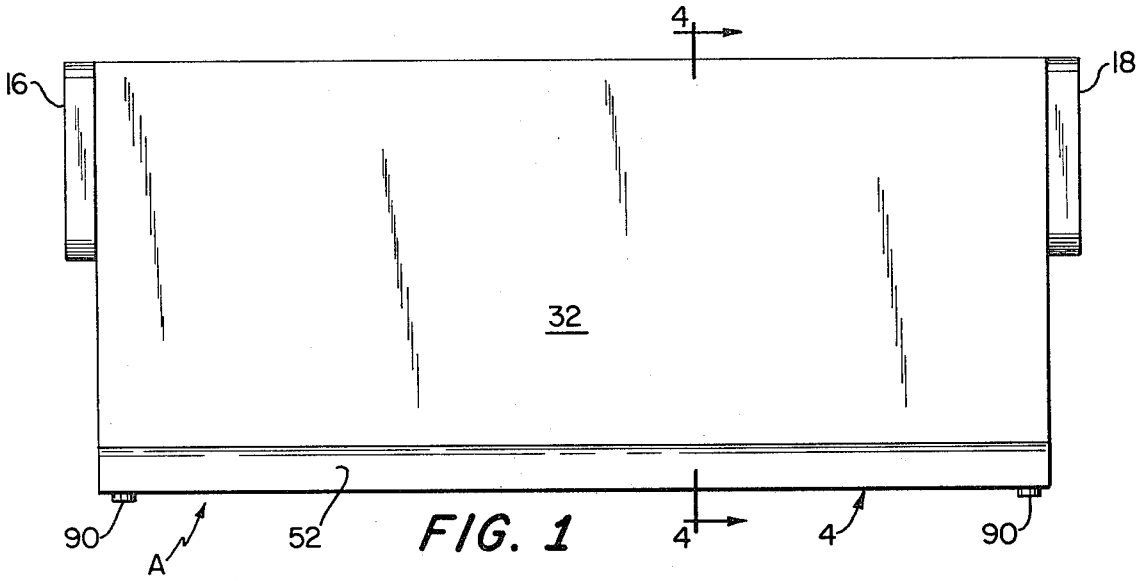
FIG. 1 is a front view in elevation of the storage component with the shelf in its down or display position.
Figure 2:
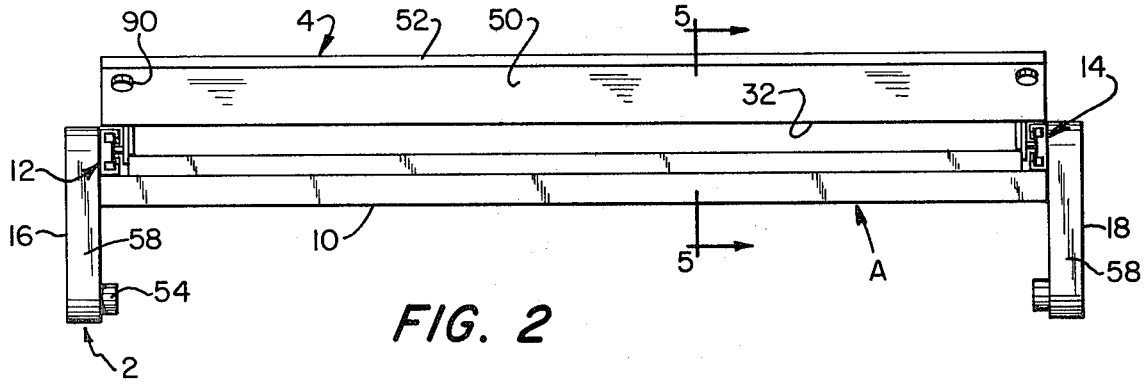
FIG. 2 is a view like FIG. 1 but with the shelf in its up or flat storage position.
Figure 6:
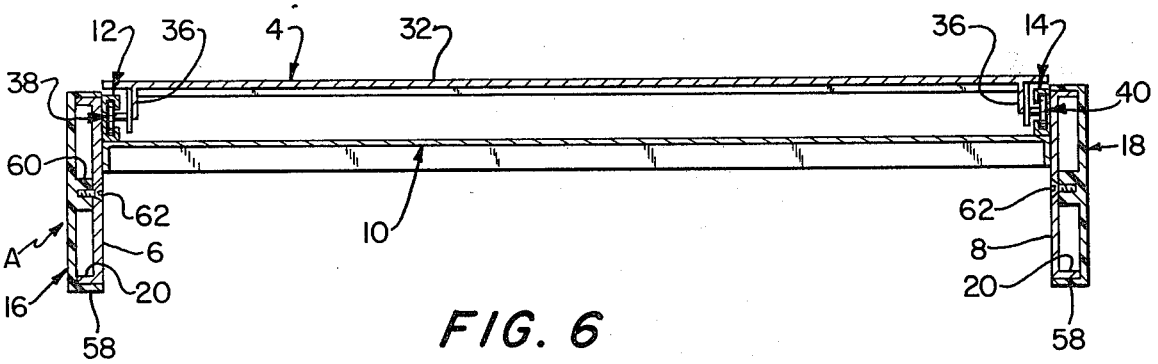
Figure 4:
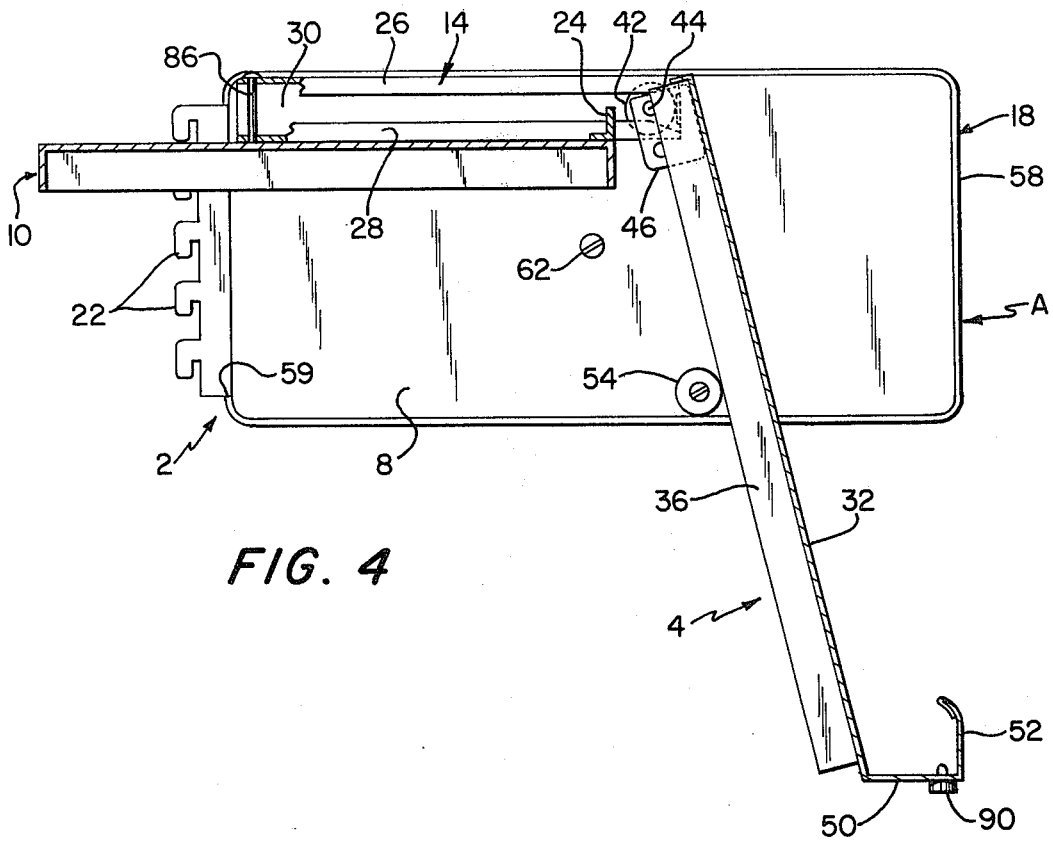
Figure 5:
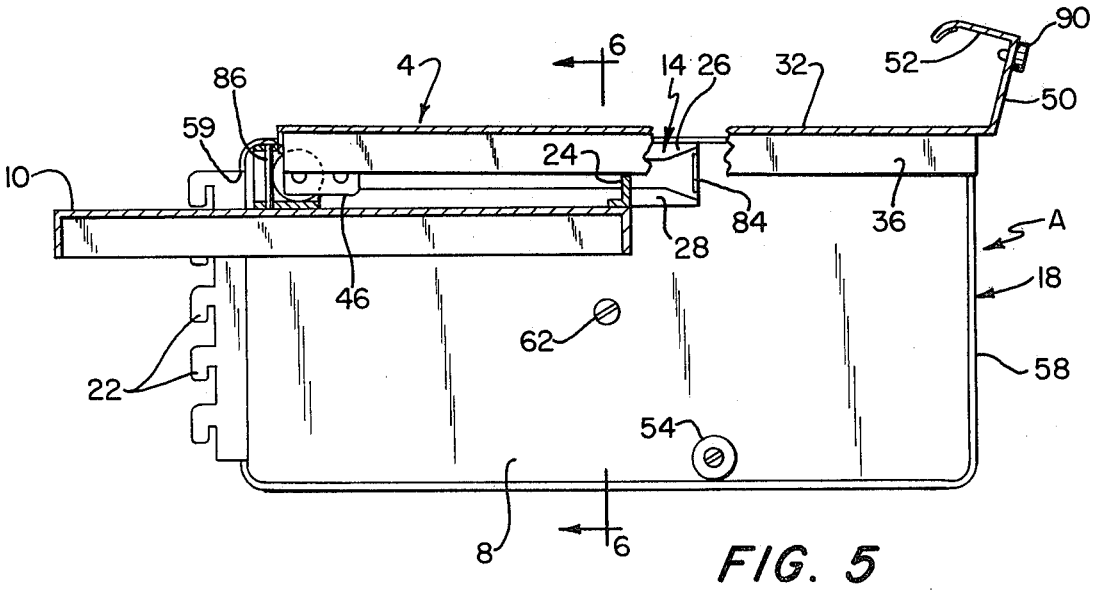

FIGS. 4 and 5 are longitudinal sectional views in elevation taken along lines 4—4 and 5—5 of FIGS. 1 and 2 respectively showing the shelf in its down and up positions respectively; and FIG. 6 is a cross-sectional view in elevation taken along line 6—6 of FIG. 5.

The storage component constituting the preferred embodiment of the invention is identified generally by the letter A and comprises a frame assembly 2 and a shelf assembly 4. Frame assembly 2 comprises a frame which is a welded fabrication of five parts 6, 8, 10, 12 and 14 and two cover plates 16 and 18. Parts 6 and 8 are metal side plates of generally rectangular configuration formed with outwardly extending flanges 20 at their front, upper and lower edges and a plurality of hooks 22 at their rear edges. Part 10 is a metal spreader plate which extends between and has portions of its opposite ends welded to side plates 6 and 8 respectively at corresponding locations so as to extend at a right angle to those side plates. Spreader plate 10 has an upstanding flange 24 along its front edge. Track members 12 and 14 are of C-shaped cross-section, consisting of upper and lower L-shaped flanges 26 and 28 formed integral with a connecting web portion 30 that is welded to the adjoining side plate 6 or 8. Tracks 12 and 14 commence a substantial distance from the front edges of side plates 6 and 8 and terminate close to but short of hooks 22. The tracks are located above but adjacent to spreader plate 10, with the latter being parallel to the tracks and also the upper and lower edges of side plates 6 and 8.

The shelf assembly 4 consists of a metal plate 32 which serves as a shelf, two flat reinforcing struts 34 and 36 attached to opposite sides of plate 32 and two like roller assemblies 38 and 40 carried by struts 34 and 36. Each roller assembly comprises a roller 42 rotatably carried by a stub shaft 44 affixed to a mounting plate 46. The two plates 46 are secured to struts 34 and 36 by welding or fasteners or other suitable means. The front end of shelf 32 is bent back upon itself so as to form an angularly disposed flange 50 terminating in a lip 52. Flange 50 and lip 52 function to retain documents on the shelf when the latter is in the position shown in FIGS. 1 and 4, and also act as a handle whereby the shelf may be moved to one or the other of its two limit positions. Shelf 32 and rollers 42 are arranged so that the rollers will fit within tracks 12 and 14 as shown in FIG. 6 and be able to ride along the tracks so as to permit the shelf to be pulled forward or pushed back. Affixed to the inner side of each of the side plates 6 and 8 is a rubber bumper 54. These two bumpers are located so as to intercept the shelf when it is pulled into its forward position and released, whereby to hold the shelf inclined at a suitable angle, preferably about 15 degrees to the vertical.

Completing the above-described storage component are the two side cover plate 16 and 18. These plate have flanges 58 formed at their front, back, top and bottom edges and are shaped so that flanges 58 overlap and lie closely adjacent to the corresponding flanges 20 of two side plates 6 and 8. The rear flange 58 of each side cover plate is cut away as shown at 59 in FIGS. 4 and 5 so as to accommodate the hooks 22. Cover plates 16 and 18 are made of plastic and have tapped bosses 60 on their inner surfaces which receive screws 62 that pass through side plates 6 and 8 and act to lock the cover plates to the side plates.

Figure 3:
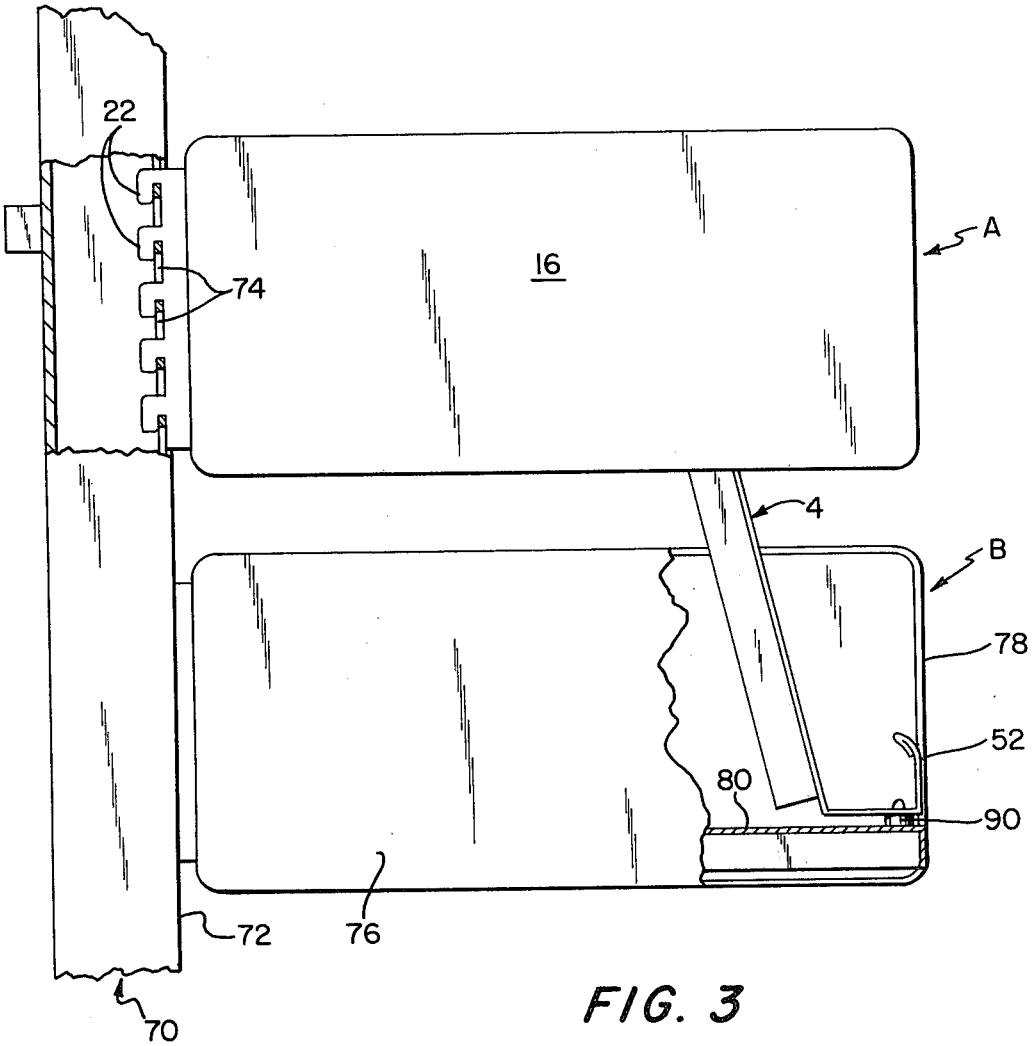
FIG. 3 is a side view in elevation showing the storage component attached to a library stand with the shelf in its down position adjacent to another lower storage component.

In practice the above described storage component A is mounted to a library unit stand 70 (FIG. 3). Although not shown in full, it is to be understood that stand 70 consists of vertical mutually spaced side frame members 72 (only one of which is shown) having their lower ends mounted to a horizontal base (not shown) and their upper ends connected and held fixed in mutually spaced relation by a horizontal cross-piece (also not shown). In the usual case the base of the library stand rests on a floor. Side frame members 72 are formed with a series of vertically spaced and vertically elongated apertures 74 along their lengths. Apertures 74 are sized to accept hooks 22 so that the storage component A will be attached to and supported in cantilever fashion by the library stand. In the same way, a plurality of storage component like or different from the one shown in FIGS. 1, 2 and 4–6 may be mounted to the library stand, one above the other in selected positions with adjustable spacing between them. By way of example in FIG. 3 a second storage component B is shown attached to stand 70 below but close to componnent A. Component B is like component A in that it has two side sections 76 and 78 with rear hooks (not shown) for interlocking with the side frame members 72. These side sections are secured to opposite sides of and support a substantially rigid plate 80 which extends horizontally and serves as a flat and stationary shelf. Obviously the height of shelf 80 can be varied by moving component B up or down on stand 70.

It is to be noted that the travel of rollers 42 along tracks 12 and 14 is limited in one direction by engagement of the rollers with stops 84 (FIG. 5) affixed to the front ends of the tracks and in the other direction by engagement of the rollers with stops 86 attached to the rear ends of the same tracks. Stops 84 are inturned flanges formed integral with tracks 12 and 14 and arranged to be engaged by rollers 42 when the shelf assembly is pulled forward along tracks 12 and 14. Stops 86 are pins each of which is located in holes in the upper and lower flanges 26 and 28 of one of the tracks 12 and 14. Stops 86 are loose and may be lifted out from the tracks to permit detachment of the shelf assembly from the frame assembly. When the shelf is lifted from its hanging position (FIGS. 1 and 4) and pushed rearwardly, the shelf will pass above the spreader plate and when the rollers engage stops 86, releasing the shelf will result in its forward end coming to rest upon and being supported by the upstanding flange 24 on the front end of spreader plate 10. At this point the shelf is substantially horizontal and its front end is nearly flush with the front edges of cover plates 16 and 18. In this position magazines or other periodicals on the shelf are considered to be in stored position just as they would be on an ordinary flat shelf. In this position the shelf cannot obscure the next lower storage compartment B or hinder access to documents stored thereby. In the usual installation, when the shelf is moved forward as far as permitted by stop members 84 and released, its front end will drop down until it is engaged and supported by bumpers 54, and the rear end of the shelf will be suspended by rollers 42 coacting with tracks 12 and 14. Depending upon the height of the next lower storage component, shelf 32 may or may not hang down in front of that other storage component and may even engage and be stopped by it before it can come to rest on bumpers 54. In practice, the storage components are usually positioned so that the shelf can come to rest on bumpers 54. However, because of such other possibility, additional rubber bumpers 90 are attached to flange 50 in position to engage an intercepting portion of the next lower storage compartment B, e.g., shelf 80. It is to be understood that bumpers 54 may be omitted where it is intended that when shelf 30 is moved to its down position, its bumpers 90 will engage and rest upon a portion of a lower storage component. Further by way of example, if storage component B were to be replaced by a component identical to component A, bumpers 90 on the upper A component could come to rest on the lip 52 of the shelf of the lower A component when the latter is in the raised position shown in FIG. 5.

The advantages of the invention are obvious from the foregoing description. First of all, it permits a library stand to store periodicals and the like flat as on conventional shelving and also to display them at an angle for easy viewing and access. Secondly even though it can display documents as described, the shelf 32 can be lifted and returned to the store position to permit access to articles stored immediately below it on the same or different form of storage component. Thirdly, by using it on a library unit having another kind of storage component, e.g., a suspension bar, the library unit is adapted to store mixed but related media, e.g., reels of computer tape and bound computer program listings or computer manuals in proximity to one another for user convenience.

A further advantage is that the hooks 22 permit the storage component to be easily attached and detached from the library unit stand, detachment being accomplished by lifting the component until the hooks are free to be pulled away from the stand and attachment being accomplished by locating the hooks in the hook-receiving holes in the stand and then lowering the component to cause the hooks to interlock with the stand. Still other advantages are that these storage components are relatively simple and can be made strong and durable and at reasonable cost. The storage components also may be made in different sizes and their construction can be modified in various ways without departing from the principles of the invention. Thus, for example, the cover plates may be omitted although they are preferred for aesthetic reasons. Also the shelf and the supporting frame assembly may be made of plastic or other materials instead of metal and a different mode of attaching the rollers to the shelf may be used. Also the shelf could be formed with projections for engaging the bumpers 54 or the latter could be replaced by some other means for supporting the shelf in its inclined display position. One or more additional spreader members may be used to connect the two side plates together for greater strength and stability. It also is appreciated that it might be possible although less practical to attach the rollers to the side plates and attach the tracks to the shelf, so that the rollers remain at the same positions at all times and the tracks move relative to the rollers when the shelf is moved in or out. Also the hooks 22 could be omitted and the side plates attached to the library unit frame by some other means such as nuts and bolts. The number of hooks 22 also is variable although at least two should be provided on each side plate for stable attachment to the library unit frame. Component A also could be arranged so that the shelf 32 is slightly inclined when it is resting in its raised position. Other advantages and modifications will be obvious to persons skilled in the art.

What is claimed is:

1. A storage shelf for storing documents such as magazines, periodicals, pamphlets and the like comprising a frame assembly and a shelf assembly, movable between a first substantially horizontal storage position which permits access to documents stored thereon and a second inclined display position, said frame assembly comprising a pair of opposite side plates, at least one member connecting and holding said side plates in parallel spaced relation, means for attaching said side frame assembly to a supporting stand, and a pair of substantially linear tracks attached to said side plates;

and said shelf assembly comprising a shelf with means at one end for preventing a magazine or other document on said shelf from slipping off of said shelf when it is located with said one end facing down; and a pair of rollers carried by said shelf immediately therebelow and engaged with said tracks, said rollers being movable along said tracks so as to permit said shelf to be moved from the first position wherein it is disposed so as to be in a substantially horizontal plane and the second position wherein it is suspended by said rollers from said tracks with said one end facing down.

2. A storage shelf according to claim 1 further including means for holding said shelf so that it is inclined at a selected angle when it is in said second position.

3. A storage shelf according to claim 1 wherein said means for attaching said side plates comprises at least two hooks.

4. A storage shelf according to claim 1 further including cover plates covering said side plates.

5. A storage shelf according to claim 1 further including stop means for limiting travel of said rollers on said tracks, said stop means, including a pin insertable within at least one of said tracks at a first end thereof, and removable to permit disassembly of said rollers from said track.

6. A storage shelf according to claim 1 in combination with a library unit stand having a pair of vertical side members with a series of spaced apertures in each side member, said means for attaching said side frame assembly to a supporting stand comprising two or more hooks on each of said side plates, said hooks being located in certain of said apertures and interlocked with said vertical side members so as to hold said side plates in cantilevered relation with said library unit stand.

7. A storage shelf of claim 5 wherein the track includes a first portion having two opposing "L" shaped flanges connected by a web, and a substantially open portion colinear with and adjacent to said first portion, wherein said pin is insertable through a hole in said track; and whereby when said rollers are disposed in said open portion said shelf assembly can be removed from said frame assembly.

8. A storage shelf of claim 7 further including stop means integrally formed in a second end of said one track for limiting travel of said rollers on said track in the direction of said second end.

* * * * *